United States Patent [19]

Proctor

[11] 4,068,896

[45] Jan. 17, 1978

[54] MINERAL CUTTER CHAINS

[75] Inventor: Sidney Ernest Proctor, High Wycombe, England

[73] Assignee: Austin Hoy & Company Limited, High Wycombe, England

[21] Appl. No.: 731,841

[22] Filed: Oct. 12, 1976

[30] Foreign Application Priority Data

Oct. 23, 1975 United Kingdom ..... 43675/75

[51] Int. Cl.[2] ..... E21C 25/34

[52] U.S. Cl. ..... 299/83

[58] Field of Search ..... 299/82–84; 30/381–387; 83/830–834; 175/411

[56] References Cited

U.S. PATENT DOCUMENTS

| | | | |
|---|---|---|---|
| 1,832,947 | 10/1933 | Anderson | 299/82 |
| 1,832,949 | 10/1933 | Anderson | 299/82 |
| 1,932,948 | 10/1933 | Anderson | 299/82 |

FOREIGN PATENT DOCUMENTS

| | | | |
|---|---|---|---|
| 245,379 | 6/1963 | Australia | 299/82 |
| 826,899 | 11/1951 | Germany | 299/82 |
| 462,551 | 3/1937 | United Kingdom | 299/84 |

*Primary Examiner*—Ernest R. Purser

*Attorney, Agent, or Firm*—Brady, O'Boyle & Gates

[57] ABSTRACT

A cutter chain for a mineral mining machine of the kind having links carrying cutter tool supports, the said links each comprising a pair of side-by-side members carrying hinge pins by means of which the link is joined to other links of the chain, and in which the side-by-side members are united by means of bridges formed by a pair of upstanding lugs on each side-by-side member which are inwardly curved so that they meet the corresponding lugs on the other of the side-by-side members, the lugs being united by welding and defining between them a recess in which one or more cutter tool support can be received and secured by welding.

3 Claims, 6 Drawing Figures

MINERAL CUTTER CHAINS

The invention relates to cutter chains and more particularly, but not exclusively, to cutter chains for mineral mining machines.

According to the invention there is provided a cutter chain having links thereof carrying supports for cutter tools, wherein the support-carrying links each comprise a pair of side members which are disposed side-by-side and adjacent to one another, the side members being arranged for articulation to other links of the chain, and each of the side members having a pair of lugs embracing a cutter tool support, the arrangement being such that the lugs of the side members in each pair are interconnected. Preferably the free ends of the lugs in each pair are united by welding. Preferably the cutter tool support is also secured to the side members by welding. Preferably the lugs in each pair are curved so that they meet at or near the centre line of the chain.

The invention is diagrammatically illustrated by way of example in the accompanying drawings, in which.

Figure 1:
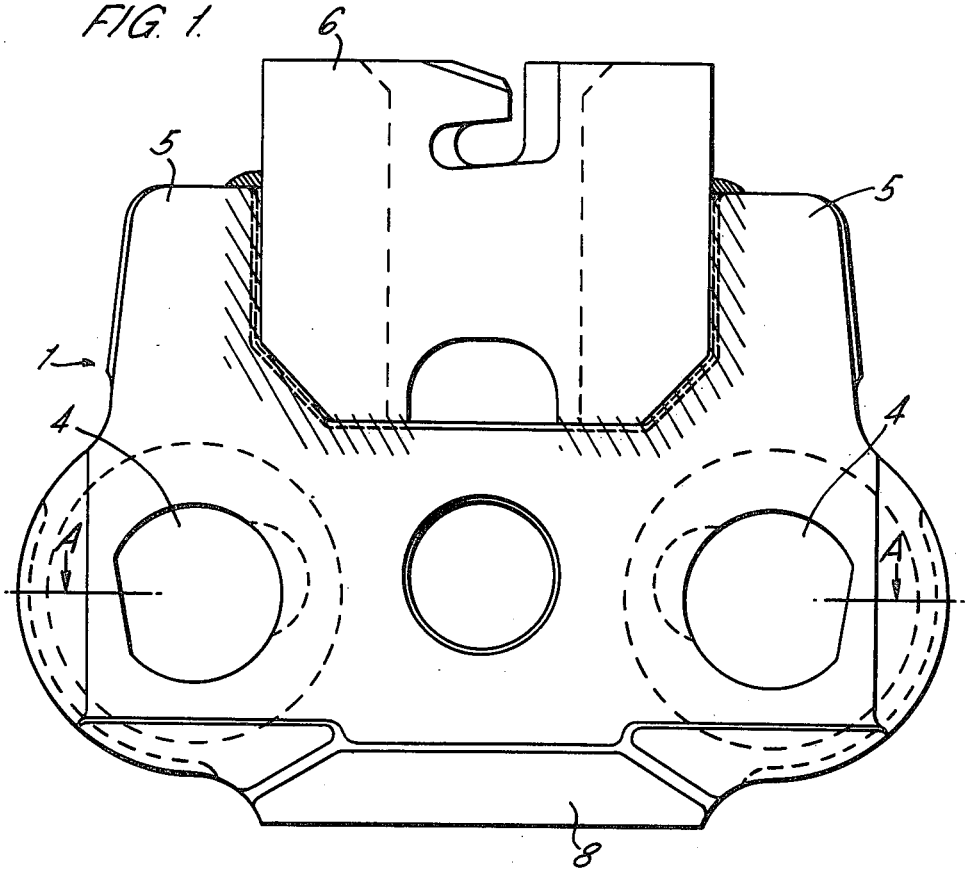
FIG. 1 is a side elevation of a first embodiment of cutter chain link in accordance with the invention.
Figure 2:
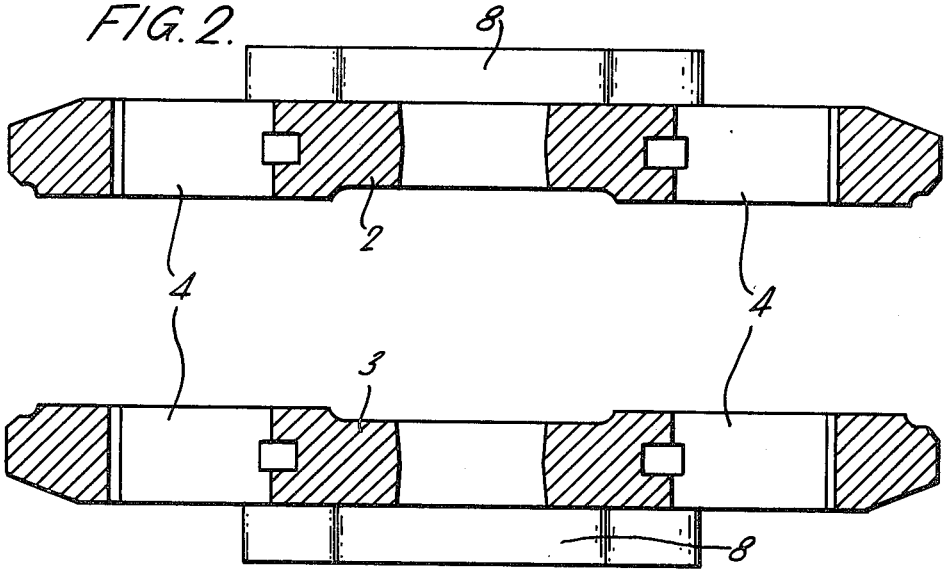
FIG. 2 is a cross-section taken on the line A—A of FIG. 1.
Figure 3:
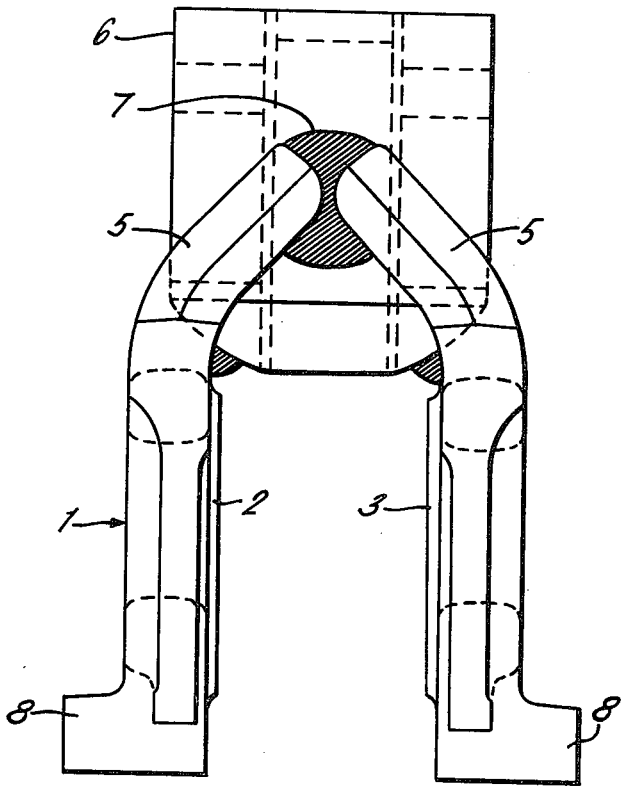
FIG. 3 is an end elevation of the arrangement illustrated in FIGS. 1 and 2.

In the drawings and referring more particularly to FIGS. 1 to 3 thereof, a link 1 of a mineral cutter chain comprises a mirror-image pair of side plates 2 and 3 formed with aligned bores 4 for receiving pins by which the chain can be articulated to other links of the chain. The pins, which are not shown in the drawings, may be of the kind described and claimed in the complete specification of our U.K. Pat. No. 1,182,600. The side plates are also formed with outwardly projecting flanges 8 arranged to be received during use of the chain in a guide track on a mineral mining machine.

Each side plate is formed with a pair of upwardly projecting lugs 5 which are bent inwardly so that they meet the corresponding lugs of the other side plate of the pair substantially on the centre line of the chain as can be seen in FIG. 3. The inner or free ends of the lugs of one side plate of the pair are united by welding with the corresponding free ends of the lugs of the other side plate of the pair at 7 so that one side plate is integral with the other side plate and forms a link of the chain. The lugs of the two side plates of the link define between them a recess in which a tool box or support 6 can be nested and secured to the link by welding.

Thus in operation forces generated during use of the cutter chain are transferred from the mineral cutter pick through the support 6 and directly to the links of the chain via the lugs 5.

The side plates may be formed for example by flame cutting from plate stock after which the lugs are bent into the shape shown in FIG. 3 or alternatively the side plates may be forged. Forging is preferred and is shown in the drawings.

It is an advantage of the arrangement described above that a degree of adjustability of the gap between the side plates can be achieved prior to uniting the side plates by welding the lugs together.

Figure 4:
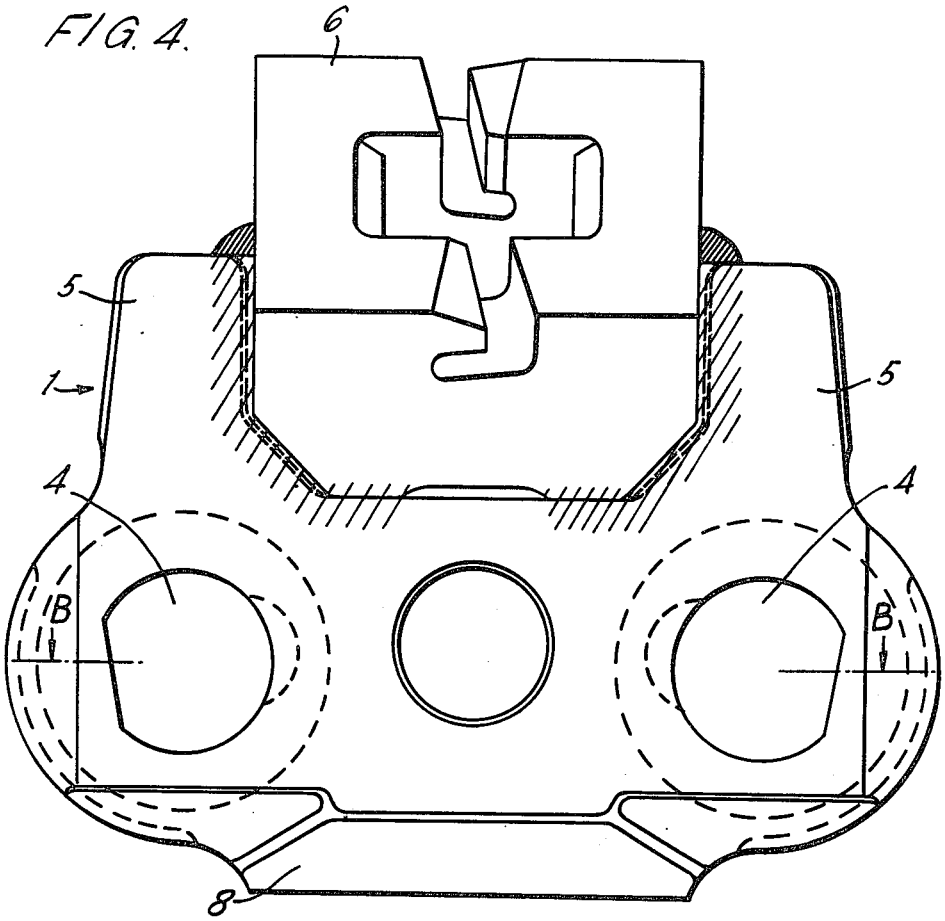
FIG. 4 is a side elevation of a second embodiment of cutter chain link in accordance with the invention.
Figure 5:
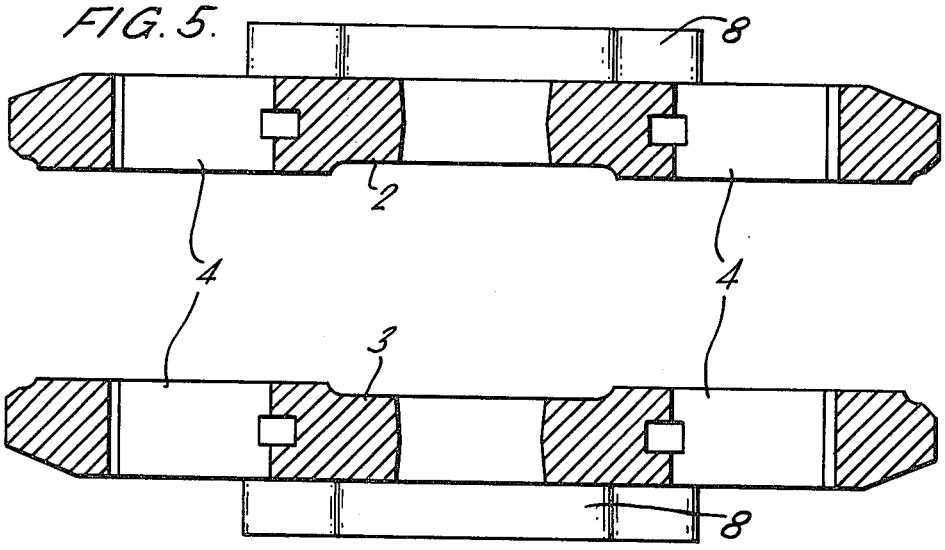
FIG. 5 is a cross-sectional elevation taken on the line B—B of FIG. 4.
Figure 6:
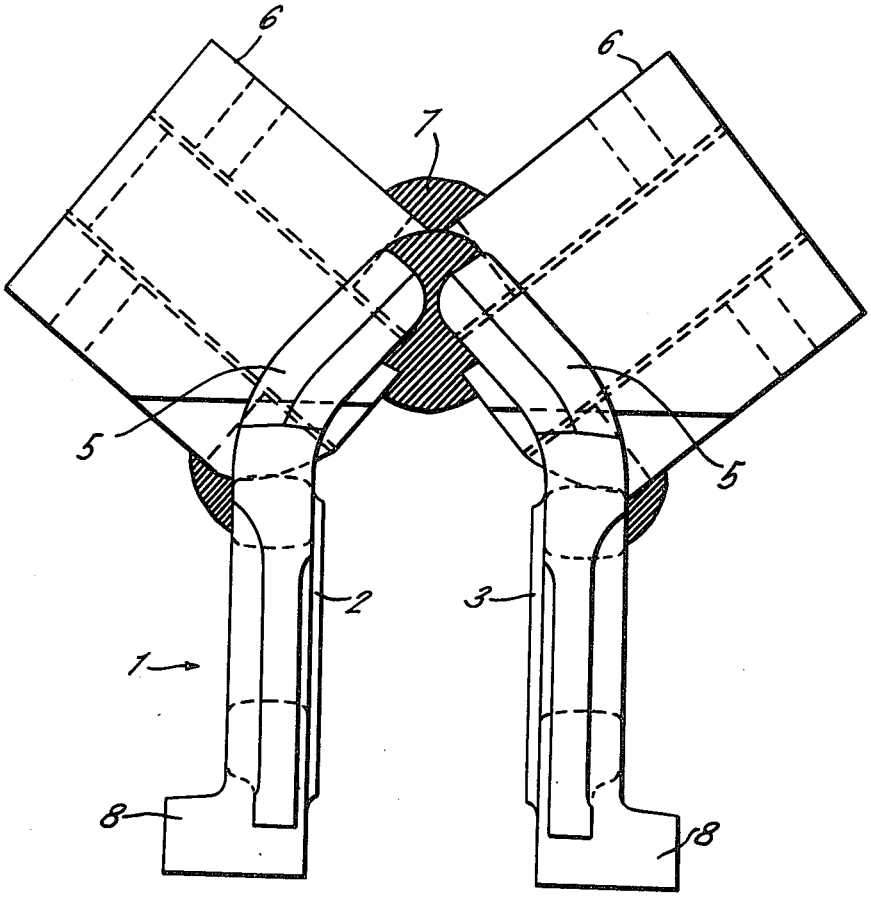
FIG. 6 is an end elevation of the arrangement shown in FIGS. 4 and 5.

The arrangement described in FIGS. 4 to 6 of the drawings is generally similar to that described above except that the link supports a pair of cutter boxes 6 within the recess defined by the four lugs 5.

I claim:

1. A cutter chain having links thereof carrying supports for cutter tools, wherein the support-carrying links each comprise a pair of side members which are disposed side-by-side and adjacent to one another, the side members being arranged for articulation to other links of the chain, and each of the side members having a pair of lugs embracing a cutter tool support, said lugs having free ends, the arrangement being such that the lugs in each pair of side members project inwardly so that they meet near the center line of the chain, and the free ends of the lugs in each pair being connected by welding.

2. A cutter chain according to claim 1, wherein the cutter tool support is secured to the side members by welding.

3. A cutter chain according to claim 1, wherein the lugs project upwardly from the side members and are inwardly curved so that their free ends extend into the vicinity of the centre-line of the chain.

* * * * *